US008114273B2

(12) United States Patent
Touffait et al.

(10) Patent No.: US 8,114,273 B2
(45) Date of Patent: Feb. 14, 2012

(54) TWO STAGE HYDROTREATING OF DISTILLATES WITH IMPROVED HYDROGEN MANAGEMENT

(75) Inventors: Benoit Touffait, Istres (FR); Herve Innocenti, Simiane-Collongue (FR); Jamil Zaari, Eyguieres (FR); Bal K. Kaul, Fairfax, VA (US); Narasimhan Sundaram, Annandale, VA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 11/795,551

(22) PCT Filed: Jan. 23, 2006

(86) PCT No.: PCT/US2006/002301
§ 371 (c)(1),
(2), (4) Date: Apr. 17, 2008

(87) PCT Pub. No.: WO2006/079030
PCT Pub. Date: Jul. 27, 2006

(65) Prior Publication Data

US 2008/0277317 A1 Nov. 13, 2008

(51) Int. Cl.
*C10G 45/02* (2006.01)

(52) U.S. Cl. ..... 208/210; 208/209; 208/213

(58) Field of Classification Search ..... 208/57, 208/58, 59, 210, 213, 209
See application file for complete search history.

(56) References Cited

U.S. PATENT DOCUMENTS

| | | | |
|---|---|---|---|
| 4,194,892 | A | 3/1980 | Jones et al. |
| 5,540,758 | A | 7/1996 | Agrawal et al. |
| 6,063,161 | A | 5/2000 | Keefer et al. |
| 6,361,583 | B1 | 3/2002 | Pinnau et al. |
| 6,406,523 | B1 | 6/2002 | Connor et al. |
| 6,451,095 | B1 | 9/2002 | Keefer et al. |
| 6,488,747 | B1 | 12/2002 | Keefer et al. |
| 6,533,846 | B1 | 3/2003 | Keefer et al. |
| 6,565,635 | B2 | 5/2003 | Keefer et al. |
| 6,607,584 | B2 | 8/2003 | Moreau et al. |
| 6,623,628 | B1 | 9/2003 | Bronner et al. |
| 7,306,651 | B2 | 12/2007 | Cieutat et al. |
| 7,384,540 | B2 | 6/2008 | Galeazzi |
| 2004/0255778 | A1 | 12/2004 | Reddy |
| 2006/0118466 | A1 * | 6/2006 | Galeazzi et al. ..... 208/210 |

FOREIGN PATENT DOCUMENTS

| | | | |
|---|---|---|---|
| EP | 1004343 | | 4/2007 |
| WO | 03044132 | | 5/2003 |
| WO | WO 03/044131 | * | 5/2003 |
| WO | 03068366 | | 8/2003 |

OTHER PUBLICATIONS

R. Farrauto, S. Hwang, L. Shore, W. Ruettinger, J. Lampert, T. Giroux, Y. Liu and O. Llinich, "New Material Needs for Hydrocarbon Fuel Processing: Generating Hydrogen for the PEM Fuel Cell," Annual Review of Materials Research, vol. 33: 1-27 (volume publication date Aug. 2003).

* cited by examiner

*Primary Examiner* — Walter D Griffin
*Assistant Examiner* — Renee E Robinson
(74) *Attorney, Agent, or Firm* — Bruce M. Bordelon; David M. Weisberg

(57) ABSTRACT

An improved hydrotreating process for removing sulfur from distillate boiling range feedstreams. This improved process utilizes a two stage hydrotreating process scheme, each stage associated with an acid gas removal zone wherein one of the stages utilizes a rapid cycle pressure swing adsorption zone to increase the concentration of hydrogen in the process.

27 Claims, 2 Drawing Sheets

TWO STAGE HYDROTREATING OF DISTILLATES WITH IMPROVED HYDROGEN MANAGEMENT

FIELD OF THE INVENTION

This invention relates to an improved hydrotreating process for removing sulfur from distillate boiling range feedstreams. This improved process utilizes a two stage hydrotreating process scheme, each stage associated with an acid gas removal zone wherein one of the stages utilizes a rapid cycle pressure swing adsorption zone to increase the concentration of hydrogen in the process.

BACKGROUND OF THE INVENTION

Hydrotreating processes are used by petroleum refiners to remove heteroatoms, including sulfur and nitrogen from hydrocarbonaceous streams such as naphtha, kerosene, diesel, gas oil, vacuum gas oil (VGO), and vacuum residue. Hydrotreating severity is selected to balance desired product yield against the desired lower levels of heteroatoms. Increasing regulatory pressure in the United States and abroad has resulted in a trend to increasing the severity and/or selectivity of hydrotreating processes to from hydrocarbon products having very low levels of sulfur.

Hydrotreating is generally accomplished by contacting a hydrocarbonaceous feedstock in a hydrotreating reaction vessel or zone with a suitable hydrotreating catalyst under conditions of elevated temperature and pressure in the presence of a hydrogen-containing treat gas to yield a product having the desired lower level of sulfur. The operating conditions and the hydrotreating catalysts utilized will influence the quality of the hydrotreated products.

Although various hydrotreating processes are practiced commercially, there is still a need in the art for improved hydrotreating processes that can be practiced more efficiently with higher hydrotreating severity or capacity.

SUMMARY OF THE INVENTION

In a preferred embodiment there is provided a process for hydrotreating a heteroatom-containing distillate boiling range feed, which process comprises:

a) contacting said distillate boiling range feed in a first hydrotreating zone in the presence of hydrogen, with a catalytically effective amount of a hydrotreating catalyst at hydrotreating conditions to result in a first liquid phase product having a reduced amount of sulfur, and a first vapor phase, which vapor phase contains hydrogen, light hydrocarbons, hydrogen sulfide and ammonia;

b) separating the first liquid phase and the first vapor phase;

c) removing hydrogen sulfide and ammonia from said first vapor phase with a basic scrubbing solution in order to form a scrubbed first vapor phase;

d) removing light hydrocarbons from said scrubbed first vapor phase thereby increasing its hydrogen concentration, in a rapid cycle pressure swing adsorption unit containing a plurality of adsorbent beds and having a total cycle time of less than about 30 seconds and a pressure drop within each adsorbent bed of greater than about 5 inches of water per foot of bed length;

e) feeding at least a portion of the scrubbed first vapor phase having an increased concentration of hydrogen to a second hydrotreating zone;

f) contacting said first liquid phase product in a second hydrotreating zone in the presence of hydrogen at least a portion of which is obtained from the scrubbed first vapor phase of step d) above, with a catalytically effective amount of a hydrotreating catalyst at hydrotreating conditions to result in a second liquid phase product having a reduced amount of sulfur, and a second vapor phase product, which second vapor phase product contains light hydrocarbons, hydrogen sulfide and hydrogen;

g) separating the second liquid phase product from the second vapor phase;

h) removing hydrogen sulfide from said second vapor phase with a basic scrubbing solution in order to form a scrubbed second vapor phase;

i) feeding at least a portion of the scrubbed second vapor phase product to said first hydrotreating zone.

In another preferred embodiment, the total cycle time of rapid cycle pressure swing adsorption is less than about 15 seconds.

In yet another preferred embodiment, the total cycle time is less than about 10 seconds and the pressure drop of each adsorbent bed is greater than about 10 inches of water per foot of bed length.

DETAILED DESCRIPTION OF THE INVENTION

The process of the present invention is particularly useful for hydrotreating distillate boiling range hydrocarbon feedstreams. Non-limiting examples of such feedstreams are those containing components boiling above about 250° F., preferably above about 300° F., and more preferably above about 350° F. Most preferably, the distillate feedstocks boil in the range of about 250 to about 850° F. (about 121 to about 454° C.). Non-limiting examples of such distillate boiling range hydrocarbon feedstreams include Fischer-Tropsch liquids; atmospheric gas oils; atmospheric pipestill sidestreams such as diesel, light diesel, and heavy diesel; vacuum gas oils; deasphalted vacuum and atmospheric residua; mildly cracked residual oils; coker distillates; straight run distillates; solvent-deasphalted oils; pyrolysis-derived oils; high boiling synthetic oils, cycle oils and cat cracker distillates.

The selected feedstock is typically admixed with a hydrogen-rich treat gas stream and introduced into a first hydrotreating reaction zone at hydrotreating reaction conditions. Hydrotreating reaction conditions will typically include a temperature from about 400° F. (204° C.) to about 900° F. (482° C.) and a liquid hourly space velocity of the feed from about 0.1 $hr.^{-1}$ to about 10 $hr.^{-1}$ and a hydrotreating catalyst or a combination of hydrotreating catalysts.

The term "hydrotreating" as used herein refers to processes wherein a hydrogen-containing treat gas is used in the presence of a suitable catalyst that is primarily active for the removal of heteroatoms, particularly sulfur. Preferred hydrotreating catalysts for use in the present invention are those that are comprised of at least one Group VIII metal, preferably selected from iron, cobalt and nickel, more preferably cobalt and/or nickel and at least one Group VI metal, preferably molybdenum or tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 wt-%, preferably from about 4 to about 12 wt-%. The Group VI metal will typically be present in an amount ranging from about 1 to about 25 wt-%, preferably from about 2 to about 25 wt-%. As previously mentioned, typical hydrotreating temperatures range from about 204° C. (400° F.) to about 482° C. (900° F.) with pressures from about 3.5 MPa (500 psig) to about 17.3 MPa (2500 psig), preferably from about 3.5 MPa (500 psig) to about 13.8 MPa (2000 psig) and a liquid hourly space velocity of the feedstream from about 0.1 $hr^{-1}$ to about 10 $hr^{-1}$.

Figure 1:
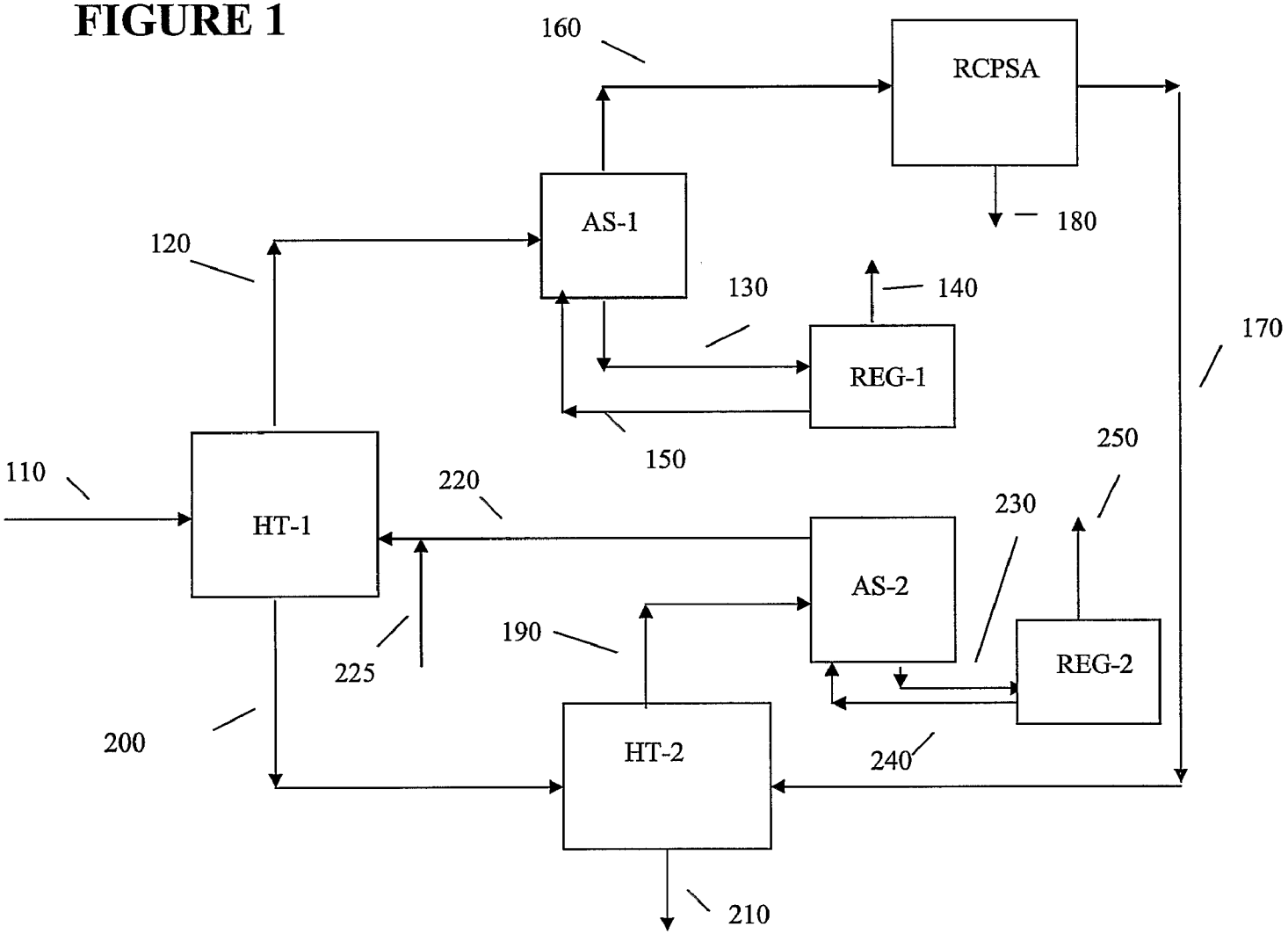
FIG. 1 hereof is a simplified schematic of a preferred embodiment when two hydrotreating stages in series is used and wherein RCPSA application is utilized in the first stage hydrogen-containing recycle gas stream to improve hydrogen purity.

FIG. 1 hereof represents one preferred embodiment of the present invention when two hydrotreating zones in series are used and wherein it is desired to remove sulfur from the feed with minimum aromatic saturation. The hydrocarbon feed 110 to be treated is introduced into a first hydrotreating zone HT-1, under effective hydrotreating conditions, along with a second hydrogen-containing recycle gas 220 and a hydrogen-containing make-up gas 225. The resulting effluent from this first hydrotreating zone is comprised of a first vapor phase stream 120 containing hydrogen, hydrogen sulfide, and light hydrocarbons; and a first liquid phase stream 200. The term "light hydrocarbons" used herein means a hydrocarbon mixture comprised of hydrocarbon compounds of about 1 to about 5 carbon atoms in weight (i.e., $C_1$ to $C_5$ weight hydrocarbon compounds).

The first liquid phase stream 200 will be lower in sulfur content since a substantial portion of the sulfur will be converted to hydrogen sulfide and be removed as part of the first vapor phase stream 120. The first vapor phase stream is conducted to first acid gas scrubbing zone AS-1 where the hydrogen sulfide is substantially removed to produce a scrubbed first vapor phase stream 160, preferably containing from about 40 vol. % to about 60 vol. % hydrogen. Any suitable basic solution can be used in the acid gas scrubbing zones AS-1 and AS-2 that will adsorb the desired level of acid gases, preferably hydrogen sulfide, from the vapor phase stream. Preferred examples of such basic solutions are the amines, preferably diethanol amine, mono-ethanol amine, and the like. Diethanol amine is more preferred. A first $H_2S$-rich scrubbing solution liquid 130, which has adsorbed at least a portion, substantially all, of the hydrogen sulfide, is conducted to a first regeneration zone REG-1 where substantially all of the hydrogen sulfide is stripped therefrom by use of a conventional stripping agent, preferably steam. The first stripping stream 140 exits regenerator REG-1 and will typically be sent to a sulfur recovery plant, such as a Claus plant. The first $H_2S$-lean scrubbing solution 150, now lean in hydrogen sulfide, is sent back to acid gas scrubbing zone AS-1.

Continuing with FIG. 1, a scrubbed first vapor phase stream 160, substantially saturated with water, is conducted to a rapid cycle pressure swing adsorption zone RCPSA. A purified first recycle gas 170, having at least about 80 vol.%, preferably at least about 85 vol.%, and more preferably at least about 90 vol.% hydrogen, is removed from the rapid cycle pressure swing adsorption unit and conducted to the second hydrotreating zone HT-1. A tail gas stream 180 rich in light hydrocarbons and other contaminants is removed from the RCPSA zone. Depending on the specific RCPSA design, other contaminants, such as, but not limited to $CO_2$, water, ammonia and $H_2S$ may also be removed from a feed. A portion of the scrubbed vapor stream may bypass the RCPSA unit.

The first liquid phase stream 200 from first hydrotreating zone HT-1 is conducted to second hydrotreating zone HT-2 where it is combined with the purified first recycle gas 170 under effective hydrotreating conditions. The hydrotreating reaction of the second hydrotreating zone HT-2 results in a second liquid phase stream 210 and a second vapor phase stream 190. The second liquid phase stream 210 is sent to additional equipment or units for additional processing or collected as a final product. The second vapor phase stream 190 is conducted to second acid gas scrubbing zone AS-2. A scrubbed second vapor phase stream 220 is conducted to the first hydrotreating zone HT-1. A hydrogen-containing make-up gas 225 can be introduced at any suitable location prior to the first hydrotreating zone HT-1, but it is preferred that it be introduced into line 220, as shown in FIG. 1. Like amine scrubbing zone AS-1, the second $H_2S$-rich scrubbing solution 230 of the second acid gas scrubbing zone AS-2 is passed to a second regeneration zone REG-2 where hydrogen sulfide is stripped from the solution in a second stripping stream 250. The $H_2S$ lean scrubbing solution 240 is recycled to the second amine scrubbing zone AS-2. The second stripping stream 250 containing stripped hydrogen sulfide is conducted from amine scrubbing zone AS-2 to a sulfur recovery plant, such as a Claus plant.

Figure 2:
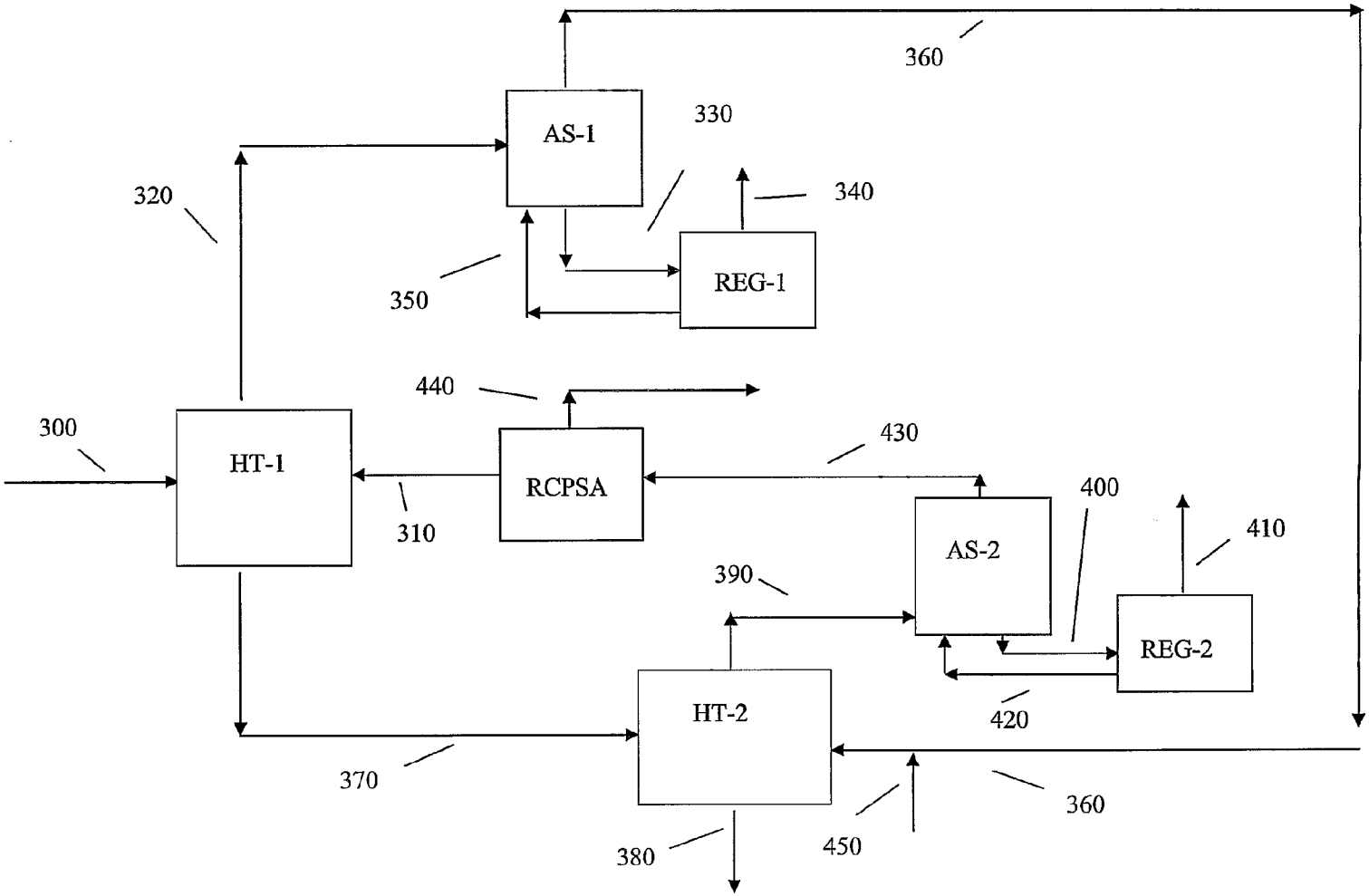
FIG. 2 hereof is a simplified schematic of a preferred embodiment when two hydrotreating stages in series is used and wherein RCPSA application is utilized in the second stage hydrogen-containing recycle gas stream to improve hydrogen purity.

In another embodiment, a rapid cycle pressure swing adsorption may be used to increase the hydrogen concentration of the hydrogen-containing make-up gas before it is introduced into the process via line 225 in this FIG. 1 and in line 450 in FIG. 2 hereof. It is understood that the hydrogen-containing make-up gas can be introduced at any suitable location in the process.

Practice of above process scheme has the unexpected advantage that the concentration of hydrogen in the hydrogen recycle loop, can be substantially increased and sulfur is removed from the feed without any significant aromatics saturation. That is, the hydrogen concentration is typically from 40 to 60 vol. % without the used of the rapid cycle pressure swing adsorption unit, but will be increased by at least about 5 vol. %, preferably at least about 10 vol. %, and more preferably at least about 15 vol. % with the use of a rapid cycle pressure swing adsorption unit as shown in this FIG. 1. This increase of hydrogen is obtained because the stream represented by 170 will have a hydrogen concentration of about 80 vol. % or more versus a hydrogen concentration of about 40 to 60 vol. % for stream 160 entering the rapid cycle pressure swing adsorption unit. Thus, the overall concentration of hydrogen in the hydrogen recycle loop will be increased by at least about 5 vol. %, preferably at least about 10 vol. %. Thus, the higher concentration of hydrogen in the recycle loop allows for higher feed rates without the need to expand the capacity of the hydrotreater reactors themselves. That is, more product can be obtained from the same hydrotreating process unit given the higher hydrogen concentrations in the recycle loop. Longer catalyst run length can also be realized by the practice of this embodiment.

FIG. 2 hereof represents one preferred embodiment of the present invention when two hydrotreating zones in series are used and RCPSA is utilized to improve the hydrogen concentration of the second stage hydrogen-containing recycle gas. The hydrocarbon feed 300 to be treated is introduced into a first hydrotreating zone HT-1, under effective hydrotreating conditions, along with a purified second recycle gas 310. The resulting effluent from this first hydrotreating zone is comprised of a first vapor phase stream 320 containing hydrogen, hydrogen sulfide, and light hydrocarbons; and a first liquid phase stream 370.

The first liquid phase stream 370 will be lower in sulfur content since a substantial portion of the sulfur will be converted to hydrogen sulfide and be removed as part of the first vapor phase stream 320. The first vapor phase stream is conducted to first acid gas scrubbing zone AS-1 where the hydrogen sulfide is substantially removed to produce a first hydrogen-containing recycle gas stream 360. Any suitable basic solution can be used in the acid gas scrubbing zones AS-1 and AS-2 that will adsorb the desired level of acid gases, preferably hydrogen sulfide, from the vapor phase stream. A first $H_2S$-rich scrubbing solution liquid 330, which has adsorbed at least a portion, substantially all, of the hydrogen sulfide, is conducted to a first regeneration zone REG-1 where substantially all of the hydrogen sulfide is stripped therefrom by use of a conventional stripping agent, preferably steam. The first stripping stream 340 exits regenerator REG-1 and will typically be sent to a sulfur recovery plant, such as a Claus plant. The first $H_2S$-lean scrubbing solution 350, now lean in hydrogen sulfide, is sent back to acid gas scrubbing zone AS-1.

The first hydrogen-containing recycle gas stream 360 is conducted to a second hydrotreating zone HT-2 along with the first liquid phase stream 370, under effective hydrotreating conditions. A second vapor phase stream 390 and a second liquid phase stream 380 are removed from the second hydrotreating zone HT-2. The second liquid phase stream 380, which is now substantially reduced in sulfur, is sent to additional equipment or units for additional processing or collected as a final product. The second vapor phase stream 390 is conducted from the second hydrotreating zone HT-2 to second acid gas scrubbing zone AS-2 which is operated similar to as discussed for the first acid gas scrubbing zone AS-1. The second $H_2S$-rich scrubbing solution 400 is regenerated by conducting it to a regenerator REG where a second stripping stream 410, which is high in $H_2S$ concentration, is removed from the regenerator. The second $H_2S$-lean scrubbing solution 420 is recycled to the second acid gas scrubbing zone AS-2. The scrubbed second vapor stream 430 is conducted to a rapid cycle pressure swing absorption unit RCPSA where light hydrocarbons are removed via the tail gas 440 from the RCPSA unit. A resulting purified second recycle gas 310, wherein the concentration of hydrogen in purified second recycle gas 310 from the RCPSA unit is greater than the concentration of hydrogen in the scrubbed second vapor stream 430. A hydrogen-containing make-up gas 450 can be introduced at any suitable location in the hydrogen recycle loop, but it is preferred that it be introduced into line 360, as shown in FIG. 2.

In Conventional Pressure Swing Adsorption ("conventional PSA") a gaseous mixture is conducted under pressure for a period of time over a first bed of a solid sorbent that is selective or relatively selective for one or more components, usually regarded as a contaminant that is to be removed from the gas stream. It is possible to remove two or more contaminants simultaneously but for convenience, the component or components that are to be removed will be referred to in the singular and referred to as a contaminant. The gaseous mixture is passed over a first adsorption bed in a first vessel and emerges from the bed depleted in the contaminant that remains sorbed in the bed. After a predetermined time or, alternatively when a break-through of the contaminant is observed, the flow of the gaseous mixture is switched to a second adsorption bed in a second vessel for the purification to continue. While the second bed is in adsorption service, the sorbed contaminant is removed from the first adsorption bed by a reduction in pressure, usually accompanied by a reverse flow of gas to desorb the contaminant. As the pressure in the vessels is reduced, the contaminant previously adsorbed on the bed is progressively desorbed into the tail gas system that typically comprises a large tail gas drum, together with a control system designed to minimize pressure fluctuations to downstream systems. The contaminant can be collected from the tail gas system in any suitable manner and processed further or disposed of as appropriate. When desorption is complete, the sorbent bed may be purged with an inert gas stream, e.g., nitrogen or a purified stream of the process gas. Purging may be facilitated by the use of a higher temperature purge gas stream.

After, e.g., breakthrough in the second bed, and after the first bed has been regenerated so that it is again prepared for adsorption service, the flow of the gaseous mixture is switched from the second bed to the first bed, and the second bed is regenerated. The total cycle time is the length of time from when the gaseous mixture is first conducted to the first bed in a first cycle to the time when the gaseous mixture is first conducted to the first bed in the immediately succeeding cycle, i.e., after a single regeneration of the first bed. The use of third, fourth, fifth, etc. vessels in addition to the second vessel, as might be needed when adsorption time is short but desorption time is long, will serve to increase cycle time.

Thus, in one configuration, a pressure swing cycle will include a feed step, at least one depressurization step, a purge step, and finally a repressurization step to prepare the adsorbent material for reintroduction of the feed step. The sorption of the contaminants usually takes place by physical sorption onto the sorbent that is normally a porous solid such as activated carbon, alumina, silica or silica-alumina that has an affinity for the contaminant. Zeolites are often used in many applications since they may exhibit a significant degree of selectivity for certain contaminants by reason of their controlled and predictable pore sizes. Normally, chemical reaction with the sorbent is not favored in view of the increased difficulty of achieving desorption of species which have become chemically bound to the sorbent, but chemisorption is my no means to be excluded if the sorbed materials may be effectively desorbed during the desorption portion of the cycle, e.g., by the use of higher temperatures coupled with the reduction in pressure. Pressure swing adsorption processing is described more fully in the book entitled *Pressure Swing Adsorption*, by D. M. Ruthven, S. Farouq & K. S. Knaebel (VCH Publishers, 1994).

Conventional PSA possesses significant inherent disadvantages for a variety of reasons. For example, conventional PSA units are costly to build and operate and are significantly larger in size for the same amount of hydrogen that needs to be recovered from hydrogen-containing gas streams as compared to RCPSA. Also, a conventional pressure swing adsorption unit will generally have cycle times in excess of one minute, typically in excess of 2 to 4 minutes due to time limitations required to allow diffusion of the components through the larger beds utilized in conventional PSA and the equipment configuration and valving involved. In contrast, rapid cycle pressure swing adsorption is utilized which has total cycle times of less than one minute. The total cycle times of RCPSA may be less than 30 seconds, preferably less than 15 seconds, more preferably less than 10 seconds, even more preferably less than 5 seconds, and even more preferably less 2 seconds. Further, the rapid cycle pressure swing adsorption units used can make use of substantially different sorbents, such as, but not limited to, structured materials such as monoliths.

The overall adsorption rate of the adsorption processes, whether conventional PSA or RCPSA, is characterized by the mass transfer rate constant in the gas phase ($\tau_g$) and the mass transfer rate constant in the solid phase ($\tau_s$). A material's mass transfer rates of a material are dependent upon the adsorbent, the adsorbed compound, the pressure and the temperature. The mass transfer rate constant in the gas phase is defined as:

$$\tau_g = D_g/R_g^2 (\text{in cm}^2/\text{sec}) \quad (1)$$

where $D_g$ is the diffusion coefficient in the gas phase and $R_g$ is the characteristic dimension of the gas medium. Here the gas diffusion in the gas phase, $D_g$, is well known in the art (i.e., the conventional value can be used) and the characteristic dimension of the gas medium, $R_g$ is defined as the channel width between two layers of the structured adsorbent material.

The mass transfer rate constant in the solid phase of a material is defined as:

$$\tau_s = D_s/R_s^2 (\text{in cm}^2/\text{sec}) \quad (2)$$

where $D_s$ is the diffusion coefficient in the solid phase and $R_s$ is the characteristic dimension of the solid medium. Here the gas diffusion coefficient in the solid phase, $D_s$, is well known in the art (i.e., the conventional value can be used) and the characteristic dimension of the solid medium, $R_s$ is defined as the width of the adsorbent layer.

D. M. Ruthven & C. Thaeron, *Performance of a Parallel Passage Absorbent Contactor*, Separation and Purification Technology 12 (1997) 43-60, which is incorporated by reference, clarifies that for flow through a monolith or a structured adsorbent that channel width is a good characteristic dimension for the gas medium, $R_g$. U.S. Pat. No. 6,607,584 to Moreau et al., which is incorporated by reference, also describes the details for calculating these transfer rates and associated coefficients for a given adsorbent and the test standard compositions used for conventional PSA. Calculation of these mass transfer rate constants is well known to one of ordinary skill in the art and may also be derived by one of ordinary skill in the art from standard testing data.

Conventional PSA relies on the use of adsorbent beds of particulate adsorbents. Additionally, due to construction constraints, conventional PSA is usually comprised of 2 or more separate beds that cycle so that at least one or more beds is fully or at least partially in the feed portion of the cycle at any one time in order to limit disruptions or surges in the treated process flow. However, due to the relatively large size of conventional PSA equipment, the particle size of the adsorbent material is general limited particle sizes of about 1 mm and above. Otherwise, excessive pressure drop, increased cycle times, limited desorption, and channeling of feed materials will result.

In an embodiment, RCPSA utilizes a rotary valving system to conduct the gas flow through a rotary sorber module that contains a number of separate adsorbent bed compartments or "tubes", each of which is successively cycled through the sorption and desorption steps as the rotary module completes the cycle of operations. The rotary sorber module is normally comprised of multiple tubes held between two seal plates on either end of the rotary sorber module wherein the seal plates are in contact with a stator comprised of separate manifolds wherein the inlet gas is conducted to the RCPSA tubes and processed purified product gas and the tail gas exiting the RCPSA tubes is conducted away from rotary sorber module. By suitable arrangement of the seal plates and manifolds, a number of individual compartments or tubes may pass through the characteristic steps of the complete cycle at any one time. In contrast with conventional PSA, the flow and pressure variations required for the RCPSA sorption/desorption cycle changes in a number of separate increments on the order of seconds per cycle, which smoothes out the pressure and flow rate pulsations encountered by the compression and valving machinery. In this form, the RCPSA module includes valving elements angularly spaced around the circular path taken by the rotating sorption module so that each compartment is successively passed to a gas flow path in the appropriate direction and pressure to achieve one of the incremental pressure/flow direction steps in the complete RCPSA cycle. One key advantage of the RCPSA technology is a significantly more efficient use of the adsorbent material. The quantity of adsorbent required with RCPSA technology can be only a fraction of that required for conventional PSA technology to achieve the same separation quantities and qualities. As a result, the footprint, investment, and the amount of active adsorbent required for RCPSA is significantly lower than that for a conventional PSA unit processing an equivalent amount of gas.

In an embodiment, RCPSA bed length unit pressure drops, required adsorption activities, and mechanical constraints (due to centrifugal acceleration of the rotating beds in RCPSA), prevent the use of many conventional PSA adsorbent bed materials, in particular adsorbents that are in a loose pelletized, particulate, beaded, or extrudate form. In a preferred embodiment, adsorbent materials are secured to a supporting understructure material for use in an RCPSA rotating apparatus. For example, one embodiment of the rotary RCPSA apparatus can be in the form of adsorbent sheets comprising adsorbent material coupled to a structured reinforcement material. A suitable binder may be used to attach the adsorbent material to the reinforcement material. Non-limiting examples of reinforcement material include monoliths, a mineral fiber matrix, (such as a glass fiber matrix), a metal wire matrix (such as a wire mesh screen), or a metal foil (such as aluminum foil), which can be anodized. Examples of glass fiber matrices include woven and non-woven glass fiber scrims. The adsorbent sheets can be made by coating a slurry of suitable adsorbent component, such as zeolite crystals with binder constituents onto the reinforcement material, non-woven fiber glass scrims, woven metal fabrics, and expanded aluminum foils. In a particular embodiment, adsorbent sheets or material are coated onto ceramic supports.

An absorber in a RCPSA unit typically comprises an adsorbent solid phase formed from one or more adsorbent materials and a permeable gas phase through which the gases to be separated flow from the inlet to the outlet of the adsorber, with a substantial portion of the components desired to be removed from the stream adsorbing onto the solid phase of the adsorbent. This gas phase may be called "circulating gas phase", but more simply "gas phase". The solid phase includes a network of pores, the mean size of which is usually between approximately 0.02 μm and 20 μm. There may be a network of even smaller pores, called "micropores", this being encountered, for example, in microporous carbon adsorbents or zeolites. The solid phase may be deposited on a non-adsorbent support, the primary function of which is to provide mechanical strength for the active adsorbent materials and/or provide a thermal conduction function or to store heat. The phenomenon of adsorption comprises two main steps, namely passage of the adsorbate from the circulating gas phase onto the surface of the solid phase, followed by passage of the adsorbate from the surface to the volume of the solid phase into the adsorption sites.

In an embodiment, RCPSA utilizes a structured adsorbent which is incorporated into the tubes utilized in the RCPSA apparatus. These structured adsorbents have an unexpectedly high mass transfer rate since the gas flows through the channels formed by the structured sheets of the adsorbent which offers a significant improvement in mass transfer as compared to a traditional packed fixed bed arrangement as utilized in conventional PSA. The ratio of the transfer rate of the gas phase ($\tau_g$) and the mass transfer rate of the solid phase ($\tau_s$) in the current invention is greater than 10, preferably greater than 25, more preferably greater than 50. These extraordinarily high mass transfer rate ratios allow RCPSA to produce high purity hydrogen streams at high recovery rates with only a fraction of the equipment size, adsorbent volume, and cost of conventional PSA.

The structured adsorbent embodiments also results in significantly greater pressure drops to be achieved through the adsorbent than conventional PSA without the detrimental effects associated with particulate bed technology. The adsorbent beds can be designed with adsorbent bed unit length pressure drops of greater than 5 inches of water per foot of bed length, more preferably greater than 10 in. $H_2O$/ft, and even more preferably greater than 20 in. $H_2O$/ft. This is in contrast with conventional PSA units where the adsorbent bed unit length pressure drops are generally limited to below about 5 in. $H_2O$/ft depending upon the adsorbent used, with most conventional PSA units being designed with a pressure drop of about 1 in. $H_2O$/ft or less to minimize the problems discussed that are associated with the larger beds, long cycle time, and particulate absorbents of conventional PSA units. The adsorbent beds of conventional PSA cannot accommodate higher pressure drops because of the risk of fluidizing the beds which results in excessive attrition and premature unit shutdowns due to accompanying equipment problems and/or a need to add or replace lost adsorbent materials. These markedly higher adsorbent bed unit length pressure drops allow RCPSA adsorbent beds to be significantly more compact, shorter, and efficient than those utilized in conventional PSA.

In an embodiment, high unit length pressure drops allow high vapor velocities to be achieved across the structured adsorbent beds. This results in a greater mass contact rate between the process fluids and the adsorbent materials in a unit of time than can be achieved by conventional PSA. This results in shorter bed lengths, higher gas phase transfer rates ($\tau_g$) and improved hydrogen recovery. With these significantly shorter bed lengths, total pressure drops of the RCPSA application of the present invention can be maintained at total bed pressure differentials during the feed cycle of about 0.5 to 50 psig, preferably less than 30 psig, while minimizing the length of the active beds to normally less than 5 feet in length, preferably less than 2 feet in length and as short as less than 1 foot in length.

The absolute pressure levels employed during the RCPSA process are not critical. In practice, provided that the pressure differential between the adsorption and desorption steps is sufficient to cause a change in the adsorbate fraction loading on the adsorbent thereby providing a delta loading effective for separating the stream components processed by the RCPSA unit. Typical absolute operating pressure levels range from about 50 to 2500 psia. However, it should be noted that the actual pressures utilized during the feed, depressurization, purge and repressurization stages are highly dependent upon many factors including, but not limited to, the actual operating pressure and temperature of the overall stream to be separated, stream composition, and desired recovery percentage and purity of the RCPSA product stream. The RCPSA process is not specifically limited to any absolute pressure and due to its compact size becomes incrementally more economical than conventional PSA processes at the higher operating pressures. U.S. Pat. Nos. 6,406,523; 6,451,095; 6,488,747; 6,533,846 and 6,565,635, all of which are incorporated herein by reference, disclose various aspects of RCPSA technology.

In an embodiment and an example, the rapid cycle pressure swing adsorption system has a total cycle time, $t_{TOT}$, to separate a feed gas into product gas (in this case, a hydrogen-enriched stream) and a tail (exhaust) gas. The method generally includes the steps of conducting the feed gas having a hydrogen purity F%, where F is the percentage of the feed gas which is the weakly-adsorbable (hydrogen) component, into an adsorbent bed that selectively adsorbs the tail gas and passes the hydrogen product gas out of the bed, for time, $t_F$, wherein the hydrogen product gas has a purity of P% and a rate of recovery of R%. Recovery R % is the ratio of amount of hydrogen retained in the product to the amount of hydrogen available in the feed. Then the bed is co-currently depressurized for a time, $t_{CO}$, followed by counter-currently depressurizing the bed for a time, $t_{CN}$, wherein desorbate (tail gas or exhaust gas) is released from the bed at a pressure greater than or equal to 1 psig. The bed is purged for a time, $t_P$, typically with a portion of the hydrogen product gas. Subsequently the bed is repressurized for a time, $t_{RP}$, typically with a portion of hydrogen product gas or feed gas, wherein the cycle time, $t_{TOT}$, is equal to the sum of the individual cycle times comprising the total cycle time, i.e.:

$$t_{TOT}=t_F+t_{CO}+t_{CN}+t_P+t_{RP} \quad (3)$$

This embodiment encompasses, but is not limited to, RCPSA processes such that either the rate of recovery, R%>80% for a product purity to feed purity ratio, P%/F%>1.1, and/or the rate of recovery, R%>90% for a product purity to feed purity ratio, 0<P%/F%<1.1. Results supporting these high recovery & purity ranges can be found in Examples 4 through 10 herein. Other embodiments will include applications of RCPSA in processes where hydrogen recovery rates are significantly lower than 80%. Embodiments of RCPSA are not limited to exceeding any specific recovery rate or purity thresholds and can be as applied at recovery rates and/or purities as low as desired or economically justifiable for a particular application.

It should also be noted that it is within the scope of this invention that steps $t_{CO}$, $t_{CN}$, or $t_P$ of equation (3) above can be omitted together or in any individual combination. However it is preferred that all steps in the above equation (3) be performed or that only one of steps $t_{CO}$ or $t_{CN}$ be omitted from the total cycle. However, additional steps can also be added within a RCPSA cycle to aid in enhancing purity and recovery of hydrogen. Thus enhancement could be practically achieved in RCPSA because of the small portion of absorbent needed and due to the elimination of a large number of stationary valves utilized in conventional PSA applications.

In an embodiment, the tail gas is also preferably released at a pressure high enough so that the tail gas may be fed to another device absent tail gas compression. More preferably the tail gas pressure is greater than or equal to 60 psig. In a most preferred embodiment, the tail gas pressure is greater than or equal to 80 psig. At higher pressures, the tail gas can be conducted to a fuel header.

Practice of the present invention can have the following benefits:

(a) Increasing the purity of hydrogen-containing stream(s) available as makeup gas, or of streams which must be upgraded to higher purity before they are suitable as make-up gas.

(b) Increasing the purity of hydrogen-containing recycle gas streams resulting in an increase in overall hydrogen treat gas purity in the reactor to allow for higher hydrotreating severity or additional product treating.

(c) Use for $H_2$ recovery from hydroprocessing purge gases, either where significant concentrations of $H_2S$ are present (before gas scrubbing) or after gas scrubbing (typically <100 vppm $H_2S$).

In hydroprocessing, increased $H_2$ purity translates to higher $H_2$ partial pressures in the hydroprocessing reactor(s). This both increases the reaction kinetics and decreases the rate of catalyst deactivation. The benefits of higher $H_2$ partial pressures can be exploited in a variety of ways, such as: operating at lower reactor temperature, which reduces energy costs, decreases catalyst deactivation, and extends catalyst life; increasing unit feed rate; processing more sour (higher sulfur) feedstocks; processing higher concentrations of cracked feedstocks; improved product color, particularly near end of run; debottlenecking existing compressors and/or treat gas circuits (increased scf $H_2$ at constant total flow, or same scf $H_2$ at lower total flow); and other means that would be apparent to one skilled in the art.

Increased $H_2$ recovery also offers significant potential benefits, some of which are described as follows:

(i) reducing the demand for purchased, manufactured, or other sources of $H_2$ within the refinery;

(ii) increasing hydroprocessing feed rates at constant (existing) makeup gas demands as a result of the increased hydrogen recovery;

(iii) improving the hydrogen purity in hydroprocessing for increased heteroatom removal efficiencies;

(iv) removing a portion of the $H_2$ from refinery fuel gas which is detrimental to the fuel gas due to hydrogen's low BTU value which can present combustion capacity limitations and difficulties for some furnace burners;

(v) Other benefits that would be apparent to one knowledgeable in the art.

The following examples are presented for illustrative purposes only and should not be cited as being limiting in any way.

EXAMPLES

Example 1

This example describes the conventional operation of refinery process units without the benefits of the invention. A first process distillate treater operating at 35 barg, is fed with a mixture of distillate fuel from different upstream processing units such as vacuum pipestills or selective catalytic treatments units, at a typical rate of 160 $m^3$/h.

A second process distillate (e.g., gas oil) treater operating at 20 barg, is fed with a mixture of oil from different upstream processing units such as atmospheric pipestills or fluid catalytic crackers, at a typical rate of 200 $m^3$/h. The second unit can be operated in conjunction with the first in different conventional modes, each mode designed to make distillate products that meet sulfur specifications. For example the first treater produces a product with 50 ppm sulfur, whereas the second treater can make either product with 2000 ppm sulfur. When the conventional unit operation is practiced by the former mode, hydrogen consumption in the second unit is 2400 $Nm^3$/h with a treat gas rate of 14 $Nm^3$/h and product sulfur is 1250 ppm. Corresponding values for the first unit are hydrogen consumption of 3500 $Nm^3$/h, treat gas rate of 27 $Nm^3$/h and product sulfur of 44 ppm. These values represent an example without the benefits of using RCPSA in the process configurations.

Example 2

This example illustrates a first embodiment of the invention as shown in FIG. 2 hereof, where the RCPSA unit is placed on the outlet of the second acid scrubber. In this mode of operation of the invention, hydrogen consumption in the second refinery unit is 3500 $Nm^3$/h with a treat gas rate of 14 $Nm^3$/h and product sulfur of 1100 ppm. Corresponding values for the first unit under this mode of operation are hydrogen consumption of 3900 $Nm^3$/h, treat gas rate of 27 $Nm^3$/h and product sulfur of 27 ppm (vs. 44 ppm in Example 1). It is seen from this example that the mode of operation described by FIG. 2 permits significant increases in hydrogen consumption in both first and second treaters and further reduced sulfur levels in both product from treaters, when compared to conventional operation described in Example 1 above. Therefore, allowing to process more feed and have more low sulfur distillate product.

Example 3

This example illustrates second embodiment of the invention, where a rapid cycle PSA unit is placed within the configuration of the units of Example 1, as shown in FIG. 1 hereof. In doing so, treat gas purity increases in second treater and consequently hydrogen consumption in the second treater increases by 1500 Nm3/h to 3900 Nm3/h. Additionally in the second unit in this mode of the invention, the treat gas rate is 9 Nm3/h and product sulfur of 1250 ppm. Corresponding values for the first unit under this embodiment of the invention are hydrogen consumption of 3500 Nm3/h, treat gas rate of 27 Nm3/h and product sulfur of 35 ppm. It will be seen from Example 2 that the mode of operation described by FIG. 1 permits an increase of hydrogen consumption by almost 50% and the reduced sulfur content (35 ppm vs 44 ppm). Unexpectedly this example illustrates that not as much sulfur reduction as in example 2 because some of the aromatics are saturated which does not leave additional hydrogen for deep desulfurization.

Example 4

In this example, the refinery stream is at 480 psig with tail gas at 65 psig whereby the pressure swing is 6.18. The feed composition and pressures are typical of refinery processing units such as those found in hydroprocessing or hydrotreating applications. In this example typical hydrocarbons are described by their carbon number i.e. $C_1$=methane, $C_2$=ethane etc. The RCPSA is capable of producing hydrogen at >99% purity and >81% recovery over a range of flow rates. Tables 1a and 1b show the results of computer simulation of the RCPSA and the input and output percentages of the different components for this example. Tables 1a and 1b also show how the hydrogen purity decreases as recovery is increased from 89.7% to 91.7% for a 6 MMSCFD stream at 480 psig and tail gas at 65 psig.

Tables 1a and 1b

Composition (mol %) of input and output from RCPSA (67 $ft^3$) in H2 purification. Feed is at 480 psig, 122 deg F. and Tail gas at 65 psig. Feed rate is about 6 MMSCFD.

TABLE 1a

| Higher purity<br>Step Times in seconds are $t_F = 1$, $t_{CO} = 0.167$, $t_{CN} = 0$, $t_P = 0.333$, $t_{RP} = 0.5$<br>H2 at 98.6% purity, 89.7% recovery | | | |
|---|---|---|---|
| | FEED | PRODUCT | TAIL-GAS |
| H2 | 88.0 | 98.69 | 45.8 |
| C1 | 6.3 | 1.28 | 25.1 |
| C2 | 0.2 | 0.01 | 1.0 |
| C3 | 2.6 | 0.01 | 12.3 |
| C4+ | 2.9 | 0.00 | 14.8 |
| H2O | 2000 vppm | 65 vppm | 9965 vppm |
| TOTAL (MMSCFD) | 6.162 | 4.934 | 1.228 |
| | 480 psig | 470 psig | 65 psig |

TABLE 1b

| Higher purity<br>Step Times in seconds are $t_F = 1$, $t_{CO} = 0.333$, $t_{CN} = 0$, $t_P = 0.167$, $t_{RP} = 0.5$<br>H2 at 97.8% purity, 91.7% recovery | | | |
|---|---|---|---|
| | FEED | PRODUCT | TAIL-GAS |
| H2 | 88.0 | 97.8 | 45.9 |
| C1 | 6.3 | 2.14 | 25.0 |
| C2 | 0.2 | 0.02 | 1.0 |
| C3 | 2.6 | 0.02 | 12.3 |
| C4+ | 2.9 | 0.00 | 14.9 |
| H2O | 2000 vppm | 131 vppm | 10016 vpm |
| TOTAL (MMSCFD) | 6.160 | 5.085 | 1.074 |
| | 480 psig | 470 psig | 65 psig |

The RCPSA's described in the present invention operate a cycle consisting of different steps. Step 1 is feed during which product is produced, step 2 is co-current depressurization, step 3 is counter-current depressurization, step 4 is purge, usually counter-current) and step 5 is repressurization with product. In the RCPSA's described here at any instant half the total number of beds are on the feed step. In this example, $t_{TOT}$=2 sec in which the feed time, $t_F$, is one-half of the total cycle.

Example 5

In this example, the conditions are the same as in Example 4. Table 2a shows conditions utilizing both a co-current and counter-current steps to achieve hydrogen purity >99%. Table 2b shows that the counter-current depressurization step may be eliminated, and a hydrogen purity of 99% can still be maintained. In fact, this shows that by increasing the time of the purge cycle, $t_P$, by the duration removed from the counter-current depressurization step, $t_{CN}$, that hydrogen recovery can be increased to a level of 88%.

Tables 2a and 2b

Effect of step durations on H2 purity and recovery from an RCPSA (67 $ft^3$). Same conditions as Table 1. Feed is at 480 psig, 122 deg F. and Tail gas at 65 psig. Feed rate is about 6 MMSCFD.

TABLE 2a

| With counter-current depress, Intermediate pressure = 105 psig. | | | | | | |
|---|---|---|---|---|---|---|
| Purity % | Recovery % | $t_F$ S | $t_{CO}$ S | $t_{CN}$ s | $t_P$ S | $t_{RP}$ S |
| 98.2 | 84.3 | 1 | 0.283 | 0.05 | 0.167 | 0.5 |
| 98.3 | 85 | 1 | 0.166 | 0.167 | 0.167 | 0.5 |
| 99.9 | 80 | 1 | 0.083 | 0.25 | 0.167 | 0.5 |

TABLE 2b

| Without counter-current depress | | | | | | |
|---|---|---|---|---|---|---|
| Purity % | Recovery % | $t_F$ S | $t_{CO}$ S | $t_{CN}$ s | $t_P$ S | $t_{RP}$ s |
| 97.8 | 91.7 | 1 | 0.333 | 0 | 0.167 | 0.5 |
| 98.7 | 90 | 1 | 0.166 | 0 | 0.334 | 0.5 |
| 99 | 88 | 1 | 0.083 | 0 | 0.417 | 0.5 |

Example 6

This example shows a 10 MMSCFD refinery stream, once again containing typical components, as shown in feed column of Table 3 (e.g. the feed composition contains 74% $H_2$). The stream is at 480 psig with RCPSA tail gas at 65 psig whereby the absolute pressure swing is 6.18. Once again the RCPSA of the present invention is capable of producing hydrogen at >99% purity and >85% recovery from these feed compositions. Tables 3a and 3b show the results of this example.

Tables 3a and 3b

Composition (mol %) of input and output from RCPSA (53 $ft^3$) in H2 purification. Feed is at 480 psig, 101 deg F. and Tail gas at 65 psig. Feed rate is about 10 MMSCFD.

TABLE 3a

| Higher purity<br>Step Times in seconds are $t_F = 0.583$, $t_{CO} = 0.083$, $t_{CN} = 0$, $t_P = 0.25$, $t_{RP} = 0.25$<br>H2 at 99.98% purity and 86% recovery | | | |
|---|---|---|---|
| | FEED | PRODUCT | TAIL-GAS |
| H2 | 74.0 | 99.98 | 29.8 |
| C1 | 14.3 | 0.02 | 37.6 |
| C2 | 5.2 | 0.00 | 13.8 |
| C3 | 2.6 | 0.00 | 7.4 |
| C4+ | 3.9 | 0.00 | 11.0 |
| H2O | 2000 vppm | 0.3 vppm | 5387 vppm |
| TOTAL (MMSCFD) | 10.220 | 6.514 | 3.705 |
| | 480 psig | 470 psig | 65 psig |

TABLE 3b

| Lower purity<br>Step Times in seconds are $t_F = 0.5$, $t_{CO} = 0.167$, $t_{CN} = 0$, $t_P = 0.083$, $t_{RP} = 0.25$<br>H2 at 93% purity and 89% recovery | | | |
|---|---|---|---|
| | FEED | PRODUCT | TAIL-GAS |
| H2 | 74.0 | 93.12 | 29.3 |
| C1 | 14.3 | 6.34 | 31.0 |
| C2 | 5.2 | 0.50 | 16.6 |
| C3 | 2.6 | 0.02 | 8.9 |

TABLE 3b-continued

| Lower purity<br>Step Times in seconds are $t_F = 0.5$, $t_{CO} = 0.167$, $t_{CN} = 0$, $t_P = 0.083$, $t_{RP} = 0.25$<br>H2 at 93% purity and 89% recovery | | | |
|---|---|---|---|
| | FEED | PRODUCT | TAIL-GAS |
| C4+ | 3.9 | 0.00 | 13.4 |
| H2O | 2000 vppm | 142 vppm | 6501 vppm |
| TOTAL (MMSCFD) | 10.220 | 7.240 | 2.977 |
| | 480 psig | 470 psig | 65 psig |

In both cases shown in Tables 3a and 3b above, although tail gas pressure is high at 65 psig, the present invention shows that high purity (99%) may be obtained if the purge step, $t_P$, is sufficiently increased.

Tables 2a, 2b and 3a show that for both 6 MMSCFD and 10 MMSCFD flow rate conditions, very high purity hydrogen at ~99% and >85% recovery is achievable with the RCPSA. In both cases the tail gas is at 65 psig. Such high purities and recoveries of product gas achieved using the RCPSA with all the exhaust produced at high pressure have not been discovered before and are a key feature of the present invention.

Table 3c shows the results for an RCPSA (volume=49 cubic ft) that delivers high purity (>99%) $H_2$ at high recovery for the same refinery stream discussed in Tables 3a and 3b. As compared to Table 3a, Table 3c shows that similar purity and recovery rates can be achieved by simultaneously decreasing the duration of the feed cycle, $t_F$, and the purge cycle, $t_P$.

TABLE 3c

| Effect of step durations on H2 purity and recovery from an RCPSA (49 ft$^3$). Feed is at 480 psig, 101 deg F. and Tail gas at 65 psig. Feed rate is about 10 MMSCFD. Without counter-current depress. | | | | | | |
|---|---|---|---|---|---|---|
| Purity % | Recovery % | $t_F$ s | $t_{CO}$ S | $t_{CN}$ S | $t_P$ s | $t_{RP}$ s |
| 95.6 | 87.7 | 0.5 | 0.167 | 0 | 0.083 | 0.25 |
| 97.6 | 86 | 0.5 | 0.117 | 0 | 0.133 | 0.25 |
| 99.7 | 85.9 | 0.5 | 0.083 | 0 | 0.167 | 0.25 |

Example 7

In this example, Table 4 further illustrates the performance of RCPSA's operated in accordance with the invention being described here. In this example, the feed is a typical refinery stream and is at a pressure of 300 psig. The RCPSA of the present invention is able to produce 99% pure hydrogen product at 83.6% recovery when all the tail gas is exhausted at 40 psig. In this case the tail gas can be sent to a flash drum or other separator or other downstream refinery equipment without further compression requirement. Another important aspect of this invention is that the RCPSA also removes CO to <2 vppm, which is extremely desirable for refinery units that use the product hydrogen enriched stream. Lower levels of CO ensure that the catalysts in the downstream units operate without deterioration in activity over extended lengths. Conventional PSA cannot meet this CO specification and simultaneously also meet the condition of exhausting all the tail gas at the higher pressure, such as at typical fuel header pressure or the high pressure of other equipment that processes such RCPSA exhaust. Since all the tail gas is available at 40 psig or greater, no additional compression is required for integrating the RCPSA with refinery equipment.

TABLE 4

| Composition (mol %) of input and output from RCPSA (4 ft$^3$) in carbon monoxide and hydrocarbon removal from hydrogen. Feed is at 300 psig, 101 deg F., and Feed rate is about 0.97 MMSCFD.<br>Step Times in seconds are $t_F = 0.5$, $t_{CO} = 0.1$, $t_{CN} = 0$, $t_P = 0.033$, $t_{RP} = 0.066$<br>H2 at 99.99% purity and 88% recovery | | | |
|---|---|---|---|
| | FEED | PRODUCT | TAIL-GAS |
| H2 | 89.2 | 99.98 | 48.8 |
| C1 | 3.3 | 0.01 | 13.9 |
| C2 | 2.8 | 0.01 | 13.9 |
| C3 | 2.0 | 0.00 | 10.2 |
| C4+ | 2.6 | 0.00 | 13.2 |
| CO | 50 | 1.1 | 198.4 |
| TOTAL | 0.971 | 0.760 | 0.211 |
| | 300 psig | 290 psig | 40 psig |

Example 8

Tables 5a and 5b compare the performance of RCPSA's operated in accordance with the invention being described here. The stream being purified has lower $H_2$ in the feed (51% mol) and is a typical refinery/petrochemical stream. In both cases (corresponding to Tables 5a and 5b), a counter current depressurization step is applied after the co-current step. In accordance with the invention, Table 5a shows that high $H_2$ recovery (81%) is possible even when all the tail gas is released at 65 psig or greater. In contrast, the RCPSA where some tail-gas is available as low as 5 psig, loses hydrogen in the counter-current depressurization such that $H_2$ recovery drops to 56%. In addition, the higher pressure of the stream in Table 5a indicates that no tail gas compression is required.

Tables 5a and 5b

Effect of Tail Gas Pressure on recovery. Example of RCPSA applied to a feed with H2 concentration (51.3 mol %). Composition (mol %) of input and output from RCPSA (31 ft$^3$) in H2 purification. Feed is at 273 psig, 122 deg F. and Feed rate is about 5.1 MMSCFD.

TABLE 5a

| Step Times in seconds are $t_F = 0.5$, $t_{CO} = 0.083$, $t_{CN} = 0.033$, $t_P = 0.25$, $t_{RP} = 0.133$<br>[A] Tail gas available from 65-83 psig,<br>H2 at 99.7% purity and 81% recovery | | | |
|---|---|---|---|
| | FEED | PRODUCT | TAIL-GAS |
| H2 | 51.3 | 99.71 | 20.1 |
| C1 | 38.0 | 0.29 | 61.0 |
| C2 | 4.8 | 0.00 | 8.0 |
| C3 | 2.2 | 0.00 | 3.8 |
| C4+ | 3.7 | 0.00 | 6.4 |
| H20 | 4000 vppm | 0.7 vppm | 6643 vppm |
| TOTAL (MMSCFD) | 5.142 | 2.141 | 3.001 |
| | 273 psig | 263 psig | 65-83 psig |

TABLE 5b

| Step Times in sec. are $t_F = 0.667$, $t_{CO} = 0.167$, $t_{CN} = 0.083$, $t_P = 0.083$, $t_{RP} = 0.33$ [B] Tail gas available from 5-65 psig, H2 at 99.9% purity and 56% recovery | | | |
|---|---|---|---|
| | FEED | PRODUCT | TAIL-GAS |
| H2 | 51.3 | 99.99 | 34.2 |
| C1 | 38.0 | 0.01 | 48.8 |
| C2 | 4.8 | 0.00 | 6.9 |
| C3 | 2.2 | 0.00 | 3.4 |
| C4+ | 3.7 | 0.00 | 6.2 |
| H20 | 4000 vppm | 0.0 vppm | 5630 vppm |
| TOTAL (MMSCFD) | 5.142 | 1.490 | 3.651 |
| | 273 psig | 263 psig | 5-65 psig |

Example 9

In this example, Tables 6a and 6b compare the performance of RCPSA's operated in accordance with the invention being described here. In these cases, the feed pressure is 800 psig and tail gas is exhausted at either 65 psig or at 100 psig. The composition reflects typical impurities such H2S, which can be present in such refinery applications. As can be seen, high recovery (>80%) is observed in both cases with the high purity >99%. In both these cases, only a co-current depressurization is used and the effluent during this step is sent to other beds in the cycle. Tail gas only issues during the countercurrent purge step. Table 6c shows the case for an RCPSA operated where some of the tail gas is also exhausted in a countercurrent depressurization step following a co-current depressurization. The effluent of the co-current depressurization is of sufficient purity and pressure to be able to return it one of the other beds in the RCPSA vessel configuration that is part of this invention. Tail gas i.e., exhaust gas, issues during the counter-current depressurization and the counter-current purge steps.

In all cases the entire amount of tail gas is available at elevated pressure which allows for integration with other high pressure refinery process. This removes the need for any form of required compression while producing high purity gas at high recoveries. In accordance with the broad claims of this invention, these cases are only to be considered as illustrative examples and not limiting either to the refinery, petrochemical or processing location or even to the nature of the particular molecules being separated.

Tables 6a, 6b, and 6c

Example of RCPSA applied to a high pressure feed. Composition (mol %) of input and output from RCPSA (18 $ft^3$) in H2 purification. Feed is at 800 psig, 122 deg F. and Feed rate is about 10.1 MMSCFD.

TABLE 6a

| Step Times in seconds are $t_F = 0.91$, $t_{CO} = 0.25$, $t_{CN} = 0$, $t_P = 0.33$, $t_{RP} = 0.33$ [A] Tail gas at 65 psig, H2 at 99.9% purity and 87% recovery | | | |
|---|---|---|---|
| | FEED | PRODUCT | TAIL-GAS |
| H2 | 74.0 | 99.99 | 29.5 |
| C1 | 14.3 | 0.01 | 37.6 |
| C2 | 5.2 | 0.00 | 14.0 |
| C3 | 2.6 | 0.00 | 7.4 |
| C4+ | 3.9 | 0.00 | 10.9 |
| H20 | 20 vppm | 0 | 55 vppm |

TABLE 6a-continued

| Step Times in seconds are $t_F = 0.91$, $t_{CO} = 0.25$, $t_{CN} = 0$, $t_P = 0.33$, $t_{RP} = 0.33$ [A] Tail gas at 65 psig, H2 at 99.9% purity and 87% recovery | | | |
|---|---|---|---|
| | FEED | PRODUCT | TAIL-GAS |
| TOTAL (MMSCFD) | 10.187 | 6.524 | 3.663 |
| | 800 psig | 790 psig | 65 psig |

TABLE 6b

| Step Times in seconds are $t_F = 0.91$, $t_{CO} = 0.25$, $t_{CN} = 0$, $t_P = 0.33$, $t_{RP} = 0.33$ [B] Tail gas at 100 psig, H2 at 99.93% purity and 80.3% recovery | | | |
|---|---|---|---|
| | FEED | PRODUCT | TAIL-GAS |
| H2 | 74.0 | 99.93 | 38.1 |
| C1 | 14.3 | 0.07 | 32.8 |
| C2 | 5.2 | 0.00 | 12.5 |
| C3 | 2.6 | 0.00 | 6.5 |
| C4+ | 3.9 | 0.00 | 9.6 |
| H2S | 20 vppm | 0 vppm | 49 vppm |
| TOTAL (MMSCFD) | 10.187 | 6.062 | 4.125 |
| | 800 psig | 790 psig | 100 psig |

TABLE 6c

| Step times in seconds are $t_F = 0.91$, $t_{CO} = 0.083$, $t_{CN} = 0.25$, $t_P = 0.167$, $t_{RP} = 0.41$ [C] Tail gas at 65-100 psig, H2 at 99.8% purity and 84% recovery | | | |
|---|---|---|---|
| | FEED | PRODUCT | TAIL-GAS |
| H2 | 74.0 | 99.95 | 28.9 |
| C1 | 14.3 | 0.05 | 39.0 |
| C2 | 5.2 | 0.00 | 13.7 |
| C3 | 2.6 | 0.00 | 7.2 |
| C4+ | 3.9 | 0.00 | 10.6 |
| H2S | 20 vppm | 0.01 vppm | 53 vppm |
| TOTAL (MMSCFD) | 10.187 | 6.373 | 3.814 |
| | 800 psig | 790 psig | 65-100 psig |

Example 10

Tables 7a, 7b, and 7c compare the performance of RCPSA's operated in accordance with the invention being described here. The stream being purified has higher $H_2$ in the feed (85% mol) and is a typical refinery/petrochemical stream. In these examples the purity increase in product is below 10% (i.e. P/F<1.1). Under this constraint, the method of the present invention is able to produce hydrogen at >90% recovery without the need for tail gas compression.

Tables 7a, 7b, and 7c

Example of RCPSA applied to a Feed with H2 concentration (85 mol %). Composition (mol %) of input and output from RCPSA (6.1 $ft^3$). Feed is at 480 psig, 135 deg F. and Feed rate is about 6 MMSCFD.

TABLE 7a

Step Times in seconds are $t_F = 0.5$, $t_{CO} = 0.33$, $t_{CN} = 0.167$, $t_P = 0.167$, $t_{RP} = 1.83$ recovery = 85%

| | FEED | PRODUCT | TAIL-GAS |
|---|---|---|---|
| H2 | 85.0 | 92.40 | 57.9 |
| C1 | 8.0 | 4.56 | 17.9 |
| C2 | 4.0 | 1.79 | 13.1 |
| C3 | 3.0 | 1.16 | 10.4 |
| C4+ | 0.0 | 0.00 | 0.0 |
| H2O | 2000 | 866.5 | 6915 |
| TOTAL (MMSCFD) | 6.100 | 4.780 | 1.320 |
| | 480 psig | 470 psig | 65 psig |

TABLE 7b

Step Times in sec. are $t_F = 1$, $t_{CO} = 0.333$, $t_{CN} = 0.167$, $t_P = 0.083$, $t_{RP} = 0.417$ recovery = 90%

| | FEED | PRODUCT | TAIL-GAS |
|---|---|---|---|
| H2 | 85.0 | 90.90 | 58.2 |
| C1 | 8.0 | 5.47 | 18.1 |
| C2 | 4.0 | 2.23 | 12.9 |
| C3 | 3.0 | 1.29 | 10.1 |
| C4+ | 0.0 | 0.00 | 0.0 |
| H2O | 2000 | 1070.5 | 6823 |
| TOTAL (MMSCFD) | 6.120 | 5.150 | 0.969 |
| | 480 psig | 470 psig | 65 psig |

TABLE 7c

Step Times in sec. are $t_F = 2$, $t_{CO} = 0.667$, $t_{CN} = 0.333$, $t_P = 0.167$, $t_{RP} = 0.833$ recovery = 90%

| | FEED | PRODUCT | TAIL-GAS |
|---|---|---|---|
| H2 | 85.0 | 90.19 | 55.2 |
| C1 | 8.0 | 6.21 | 18.8 |
| C2 | 4.0 | 2.32 | 13.9 |
| C3 | 3.0 | 1.17 | 11.3 |
| C4+ | 0.0 | 0.00 | 0.0 |
| H2O | 2000 | 1103.5 | 7447 |
| TOTAL (MMSCFD) | 6.138 | 5.208 | 0.93 |
| | 480 psig | 470 psig | 65 psig |

The invention claimed is:

1. A process for hydrotreating a heteroatom-containing distillate boiling range feed, which process comprises a) contacting said distillate boiling range feed in a first hydrotreating zone in the presence of hydrogen, with a catalytically effective amount of a hydrotreating catalyst at hydrotreating conditions to result in a first liquid phase product having a reduced amount of sulfur, and a first vapor phase, which vapor phase contains hydrogen, light hydrocarbons, hydrogen sulfide and ammonia;

b) separating the first liquid phase and the first vapor phase;

c) removing hydrogen sulfide and ammonia from said first vapor phase with a basic scrubbing solution in order to form a scrubbed first vapor phase;

d) removing light hydrocarbons from said scrubbed first vapor phase thereby increasing its hydrogen concentration, in a rapid cycle pressure swing adsorption unit containing a plurality of adsorbent beds and having a total cycle time of less than about 30 seconds and a pressure drop within each adsorbent bed of greater than about 5 inches of water per foot of bed length;

e) feeding at least a portion of the scrubbed first vapor phase having an increased concentration of hydrogen to a second hydrotreating zone;

f) contacting said first liquid phase product in a second hydrotreating zone in the presence of hydrogen at least a portion of which is obtained from the scrubbed first vapor phase of step d) above, with a catalytically effective amount of a hydrotreating catalyst at hydrotreating conditions to result in a second liquid phase product having a reduced amount of sulfur, and a second vapor phase product, which second vapor phase product contains light hydrocarbons, hydrogen sulfide and hydrogen;

g) separating the second liquid phase product from the second vapor phase;

h) removing hydrogen sulfide from said second vapor phase with a basic scrubbing solution in order to form a scrubbed second vapor phase; and i) feeding at least a portion of the scrubbed second vapor phase product to said first hydrotreating zone, wherein said removing step d) results in a recovery of a purified hydrogen-containing gas stream, relative to said hydrogen-containing make-up treat gas, said vapor phase product, or both, so as to exhibit (iv) a rate of recovery (R%) greater than 80% for a product purity to feed ratio (P%/F%) greater than 1.1, (v) a rate of recovery (R%) greater than 90% for a product purity to feed ratio (P%/F%) less than 1.1 but greater than 0, or (vi) both (iv) and (v).

2. The process of claim 1 wherein the feed is selected from the group consisting of Fischer-Tropsch liquids; atmospheric gas oils; atmospheric pipestill sidestreams selected from diesel, light diesel, and heavy diesel; vacuum gas oils; deasphalted vacuum and atmospheric residua; mildly cracked residual oils; coker distillates; straight run distillates; solvent-deasphalted oils; pyrolysis-derived oils; high boiling synthetic oils, cycle oils and cat cracker distillates.

3. The process of claim 2 wherein the hydrotreating catalyst contains one or more components selected from the group consisting of cobalt, nickel, tungsten, alumina, a zeolite, silica, silica-alumina, and molecular sieve.

4. The process of claim 2 wherein the total cycle time of rapid cycle pressure swing adsorption is less than about 15 seconds.

5. The process of claim 4 wherein the total cycle time is less than about 10 seconds and the pressure drop of each adsorbent bed is greater than about 10 inches of water per foot of bed length.

6. The process of claim 5 wherein the total cycle time is less than about 5 seconds.

7. The process of claim 6 wherein the pressure drop of greater than about 20 inches of water per foot of bed length.

8. The process of claim 1 wherein the cycle time of rapid cycle pressure swing adsorption is less than about 10 seconds and the pressure drop in each adsorbent bed is greater than about 10 inches of water per foot of bed length.

9. The process of claim 8 wherein the cycle time is less than about 5 seconds and the pressure drop if greater than about 20 inches of water per foot of bed length.

10. The process of claim 1 wherein a hydrogen-containing make-up gas is introduced into said first hydrotreating zone, which hydrogen-containing make-up gas contains hydrogen and light hydrocarbons.

11. The process of claim 10 wherein, before said hydrogen-containing make-up gas is introduced into said first hydrotreating zone, light hydrocarbons are removed therefrom in a rapid cycle pressure swing adsorption unit containing a plurality of adsorbent beds and having a total cycle time of less than about 30 seconds and a pressure drop within each adsorbent bed of greater than about 5 inches of water per foot of bed length.

12. The process of claim 11 wherein the total cycle time or rapid cycle pressure swing adsorption is less than about 10 seconds and the pressure drop in each adsorbent bed is greater than about 10 inches of water per foot of bed length.

13. The process of claim 12 wherein the total cycle time is less than about 5 seconds.

14. The process of claim 13 wherein the pressure drop of greater than about 20 inches of water per foot of bed length.

15. A process for hydrotreating distillate boiling range feed, which comprises:

a) contacting said distillate boiling range feed in a first hydrotreating zone and contacting it, in the presence of hydrogen, with a catalytically effective amount of a hydrotreating catalyst at hydrotreating conditions to result in a first liquid phase having a reduced amount of sulfur, and a first vapor phase, which vapor phase product is comprised of hydrogen, light hydrocarbons, hydrogen sulfide and ammonia;

b) separating the first liquid phase and the first vapor phase;

c) removing hydrogen sulfide from said first vapor phase with a basic scrubbing solution in order to form a scrubbed first vapor phase;

d) feeding at least a portion of the scrubbed first vapor phase to a second hydrotreating zone;

e) contacting said first liquid phase in a second hydrotreating zone and contacting it, in the presence of hydrogen at least a portion of which is obtained from the scrubbed first vapor phase of step d) above, with a catalytically effective amount of a hydrotreating catalyst at hydrotreating conditions to result in a second liquid phase having a reduced amount of sulfur, and a second vapor phase product, which vapor phase product contains light hydrocarbons, hydrogen sulfide and hydrogen;

f) separating the second liquid phase from the second vapor phase;

g) removing hydrogen sulfide from said second vapor phase with a basic scrubbing solution in order to form a scrubbed second vapor phase;

h) removing light hydrocarbons from said scrubbed second vapor phase thereby increasing its hydrogen concentration, in a rapid cycle pressure swing adsorption unit containing a plurality of adsorbent beds and having a total cycle time of less than about 30 seconds and a pressure drop within each adsorbent bed of greater than about 5 inches of water per foot of bed length; and i) feeding at least a portion of the scrubbed second vapor phase having an increased concentration of hydrogen to said first hydrotreating zone, wherein said removing step h) results in a recovery of a purified hydrogen-containing gas stream, relative to said hydrogen-containing make-up treat gas, said vapor phase product, or both, so as to exhibit (iv) a rate of recovery (R%) greater than 80% for a product purity to feed ratio (P%/F%) greater than 1.1, (v) a rate of recovery (R%) greater than 90% for a product purity to feed ratio (P%/F%) less than 1.1 but greater than 0, or (vi) both (iv) and (v).

16. The process of claim 15 wherein the feedstream is selected from the group consisting of Fischer-Tropsch liquids; atmospheric gas oils; atmospheric pipestill sidestreams selected from diesel, light diesel, and heavy diesel; vacuum gas oils; deasphalted vacuum and atmospheric residua; mildly cracked residual oils; coker distillates; straight run distillates; solvent-deasphalted oils; pyrolysis-derived oils; high boiling synthetic oils, cycle oils and cat cracker distillates.

17. The process of claim 16 wherein the cycle time of rapid cycle pressure swing adsorption is less than about 10 seconds and the pressure drop in each adsorbent bed is greater than about 10 inches of water per foot of bed length.

18. The process of claim 17 wherein the cycle time is less than about 5 seconds and the pressure drop is greater than about 20 inches of water per foot of bed length.

19. The process of claim 15 wherein the total cycle time of rapid cycle pressure swing adsorption if less than about 15 seconds.

20. The process of claim 19 wherein the total cycle time is less than about 10 seconds and the pressure drop of each adsorbent is greater than about 10 inches of water per foot of bed length.

21. The process of claim 20 wherein the total cycle time is less than about 5 seconds.

22. The process of claim 21 wherein the pressure drop of greater than about 20 inches of water per foot of bed length.

23. The process of claim 15 wherein a hydrogen-containing make-up gas is introduced into said second hydrotreating zone, which hydrogen-containing makeup gas contains hydrogen and light hydrocarbons.

24. The process of claim 23 wherein, before said hydrogen-containing make-up gas is introduced into said second hydrotreating zone, light hydrocarbons are removed therefrom in a rapid cycle pressure swing adsorption unit containing a plurality of adsorbent beds and having a total cycle time of less than about 30 seconds and a pressure drop within each adsorbent bed of greater than about 5 inches of water per foot of bed length.

25. The process of claim 24 wherein the total cycle time or rapid cycle pressure swing adsorption is less than about 10 seconds and the pressure drop in each adsorbent bed is greater than about 10 inches of water per foot of bed length.

26. The process of claim 25 wherein the total cycle time is less than about 5 seconds.

27. The process of claim 26 wherein the pressure drop of greater than about 20 inches of water per foot of bed length.

* * * * *